United States Patent [19]

Beil et al.

[11] Patent Number: 4,828,120

[45] Date of Patent: May 9, 1989

[54] OFFICE ACCESSORY SYSTEM SUSPENDIBLE FROM A VERTICAL SURFACE

[75] Inventors: Valentine Beil, Orchard Park; Peter Kotas, Alden; Douglas Rudz, Derby, all of N.Y.

[73] Assignee: McDonald Products Corporation, Buffalo, N.Y.

[21] Appl. No.: 82,737

[22] Filed: Aug. 7, 1987

[51] Int. Cl.[4] ..... A47F 5/08

[52] U.S. Cl. ..... 211/88; 211/126

[58] Field of Search ..... 211/88, 99, 101, 81, 211/150, 173, 94, 103, 207, 10, 126; 240/225.2, 311.2

[56] References Cited

U.S. PATENT DOCUMENTS

| | | | |
|---|---|---|---|
| 3,886,698 | 6/1975 | Raith et al. | 211/126 X |
| 4,051,789 | 10/1977 | Howitt | 211/190 X |
| 4,478,339 | 10/1984 | Herr et al. | 211/126 |

*Primary Examiner*—J. Franklin Foss
*Assistant Examiner*—Sarah A. Lechok Eley
*Attorney, Agent, or Firm*—Christel, Bean & Linihan

[57] ABSTRACT

An office accessory system for attachment to a wall-mounted load bar for suspension from a vertical surface includes an office accessory suitable for use in either a vertical or horizontal orientation and a pair of mounting brackets. The mounting brackets are attached to the load bar, and the office accessory has two opposite sides which cooperate with the mounting brackets to permit the accessory to be supported from the load bar in either its vertical or horizontal positions of use. When utilized to attach the accessory to the load bar, the mounting brackets are substantially hidden from view.

13 Claims, 3 Drawing Sheets

Fig. 1.
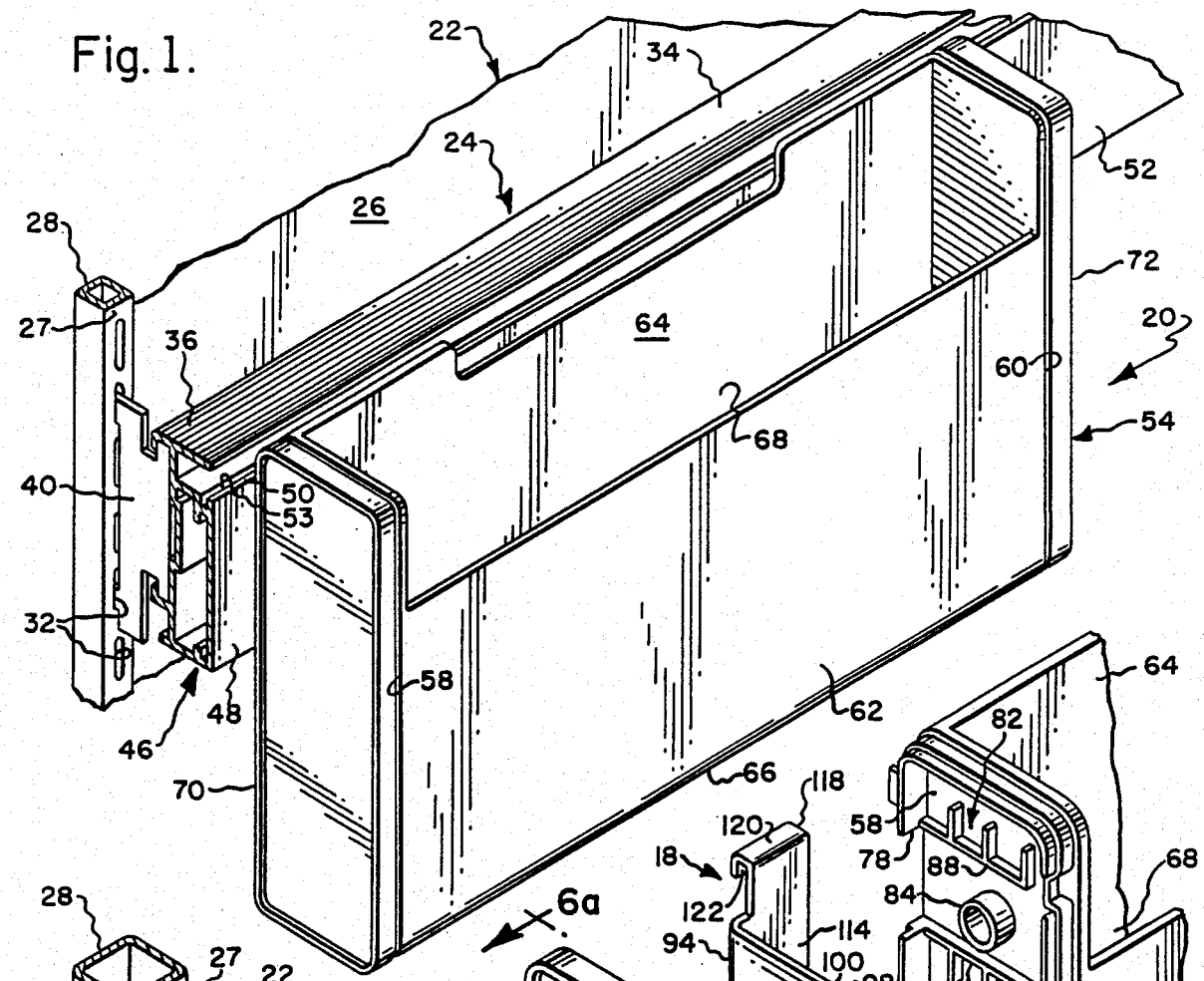
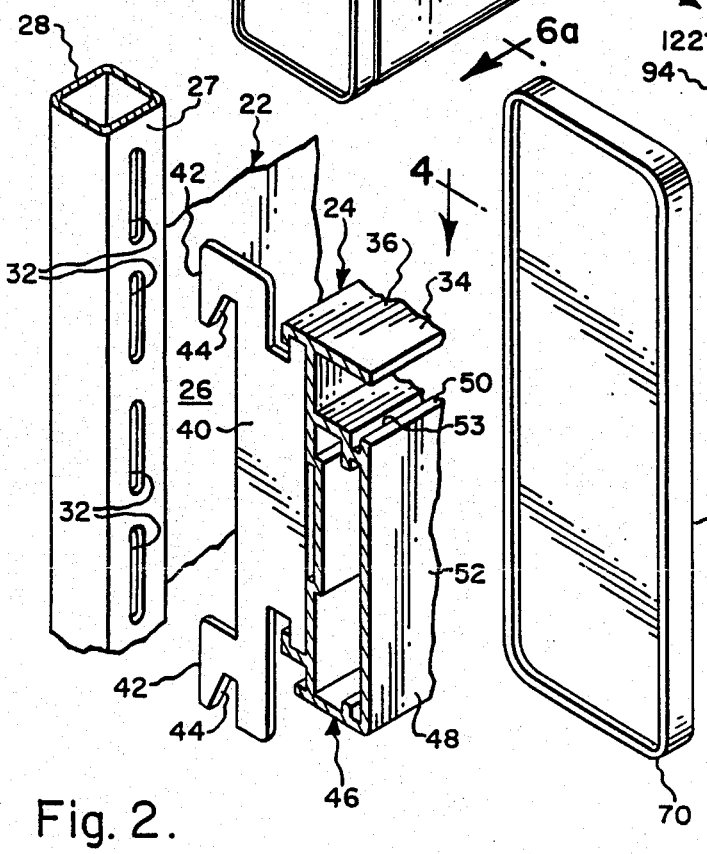
Fig. 2.
Fig. 3.

OFFICE ACCESSORY SYSTEM SUSPENDIBLE FROM A VERTICAL SURFACE

BACKGROUND OF THE INVENTION

This invention relates generally to office accessory systems and relates more particularly to an office accessory system including office accessories which are suited for use in both vertical and horizontal orientations and associated componentry with which such accessories can be suspended from a vertical surface.

The type of office accessory with which this invention is concerned includes those which are adapted for use in either a vertical or upright position or a horizontal position. Commonly, such an accessory includes two opposite sides, a bottom and a back wherein either the bottom or back of the accessory is adapted to rest upon a horizontal surface depending upon whether the horizontal surface is oriented in either the vertical or horizontal position of use. One such accessory, shown and described in U.S. Pat. No. 4,620,636, functions as a letter tray when oriented in a horizontal orientation and functions as a file holder when oriented in a vertical orientation.

A relatively recent concept relating to offices involves a dividing of an otherwise open area into individual work areas or stations. Such a concept, known as the open plan concept, utilizes modular wall panel assemblies for dividing and thereby defining the individual work areas. Concurrent with the development of office furnishings for the open-plan office concept is the development of means by which office accessories can be supported from the modular wall panels. An example of such support means is shown and described in U.S. Pat. No., 4,478,339.

It is an object of the present invention to provide a new and improved office accessory system wherein an office accessory suitable for use in both vertical and horizontal positions of use is selectively supportable from wall-mounting means in either its vertical or horizontal position of use.

Another object of the present invention is to provide such an accessory system which is particularly well-suited for use with a modular wall panel in an open-plan environment.

Still another object of the present invention is to provide such an accessory system which is economical to construct and effective in operation.

SUMMARY OF THE INVENTION

This invention resides in an office accessory system for attachment to wall-mounting means including a generally vertical surface extending generally upwardly and terminating along a horizontal edge.

The office accessory system includes an office accessory suitable for use in either a vertical or horizontal orientation and includes means defining two opposite sides, a back and a bottom. Each of the sides of the accessory includes detent means, and the system further includes a pair of mounting brackets. The mounting brackets are cooperable between the detent means of the accessory sides and the horizontal edge of the wall-mounting means for selectively supporting the office accessory in either a vertical or horizontal orientation. Each bracket is adapted to cooperate with the detent means of a corresponding accessory side and be thereby retained in a stationary position in relationship thereto in either of two positions of orientation so that when each bracket is attached to a corresponding side in a first of the two positions, the office accessory is supportable from the wall-mounting means in a vertical position of use and so that when each bracket is attached to a corresponding accessory side in a second of the two positions, the office accessory is supportable from the wall-mounting means in a horizontal position of use.

BRIEF DESCRIPTION OF THE DRAWING FIGURES

FIG. 1 is a fragmentary perspective view of an embodiment of an office accessory system in accordance with the present invention shown operatively mounted upon a vertical panel and in a vertical position of use.

FIG. 2 is a fragmentary perspective view of wall-mounting means by which the office accessory system of FIG. 1 is supported from the FIG. 1 panel.

FIG. 3 is a fragmentary perspective view, shown exploded, of one end of the FIG. 1 accessory system.

Figure 5A:
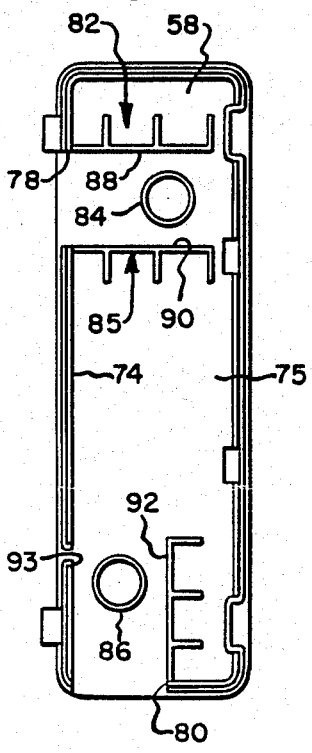

FIG. 5*a* is an elevation view of one side of the office accessory of the FIG. 1 system shown with its end cap removed.

Figure 5B:
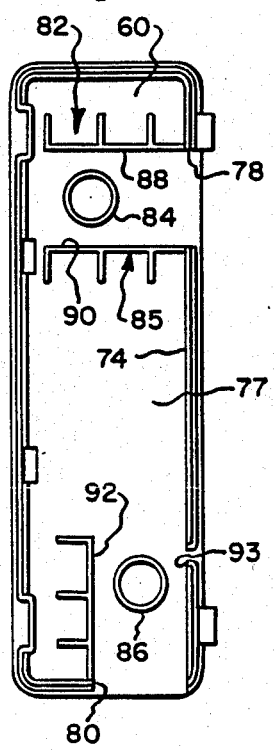

FIG. 5*b* is a view similar to that of FIG. 5*a* of the opposite side of the office accessory of the FIG. 1 system shown with its end cap removed.

Figure 6A:
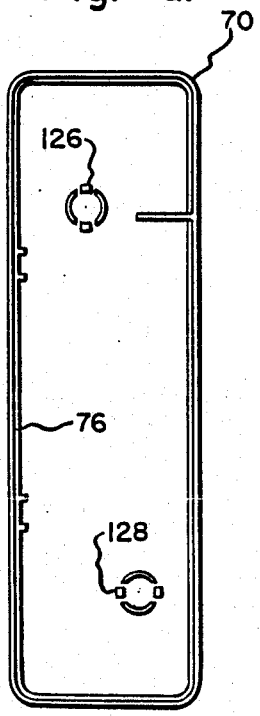

FIG. 6*a* is an elevation view of an end cap of the FIG. 1 accessory taken about on line 6*a*—6*a* of FIG. 3.

Figure 6B:
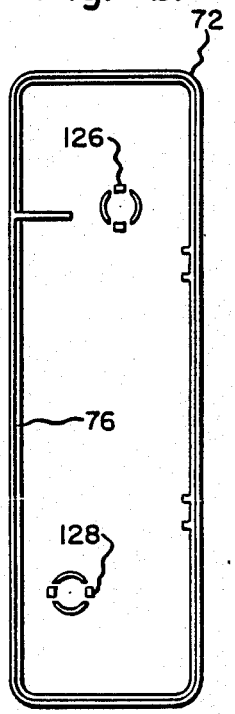

FIG. 6*b* is a view similar to that of FIG. 6*a* of the other end cap of the FIG. 1 accessory.

Figure 4:
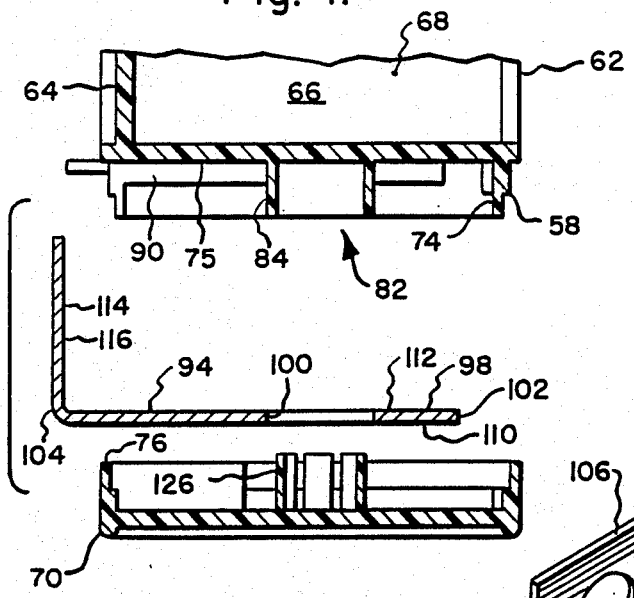
FIG. 4 is a cross-sectional view taken about on lines 4—4 of FIG. 3.
Figure 7:
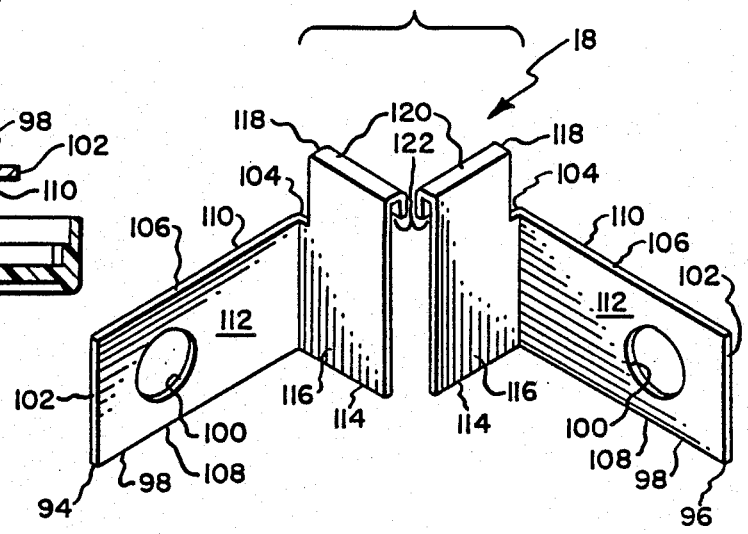

FIG. 7 is a perspective view of the mounting brackets of the FIG. 1 system.

Figure 8:
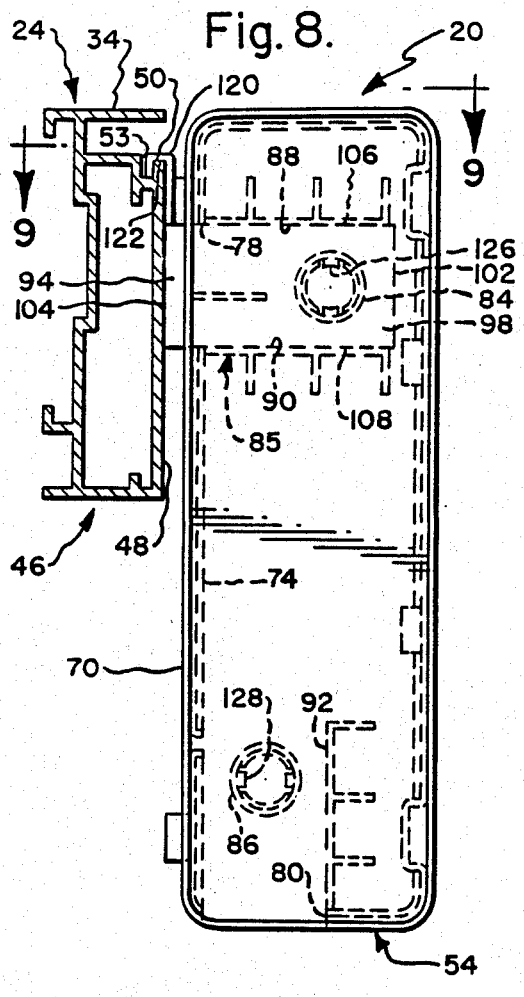

FIG. 8 is a fragmentary elevational view, shown partially in section, of an end of the FIG. 1 system when operatively attached to the wall-mounting means of the FIG. 1 vertical panel in a vertical position of use.

Figure 9:
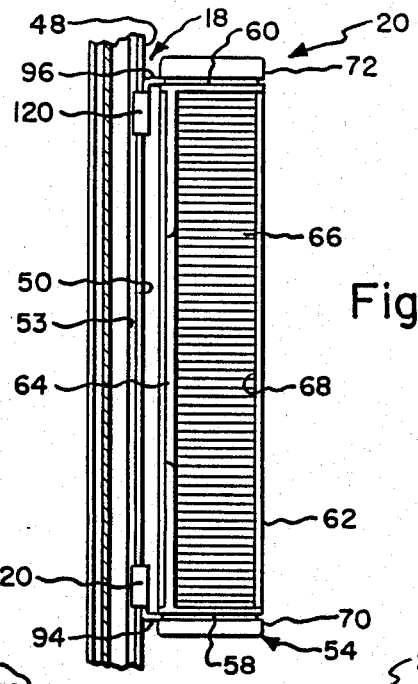

FIG. 9 is a fragmentary plan view, shown partially in section, of the FIG. 1 system and the wall-mounting means taken about on line 9—9 of FIG. 8.

Figure 10:
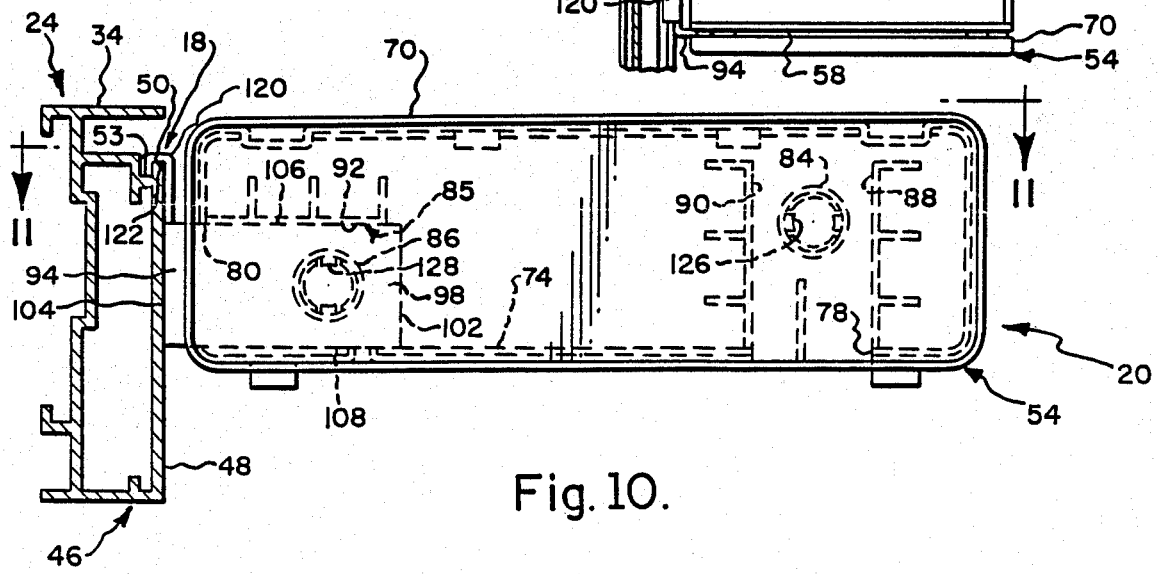

FIG. 10 is a fragmentary elevational view, shown partially in section, of an end of the FIG. 1 system when operatively attached to the wall-mounting means of the FIG. 1 vertical panel in a horizontal position of use.

Figure 11:
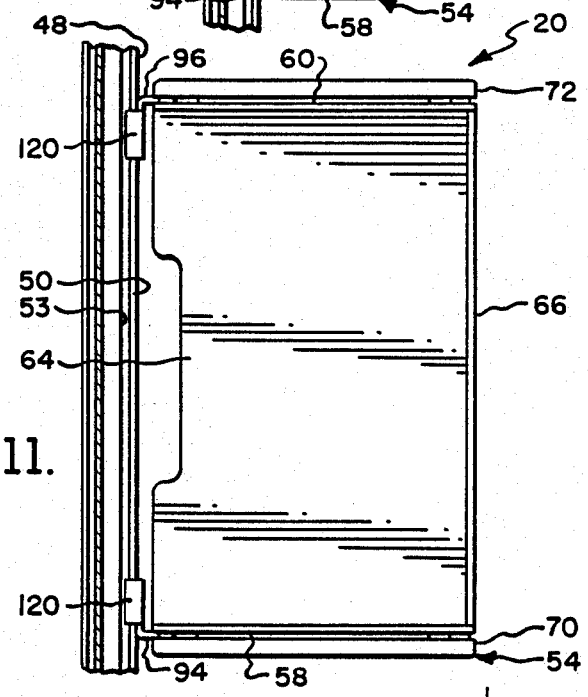

FIG. 11 is a fragmentary plan view, shown partially in section, of the FIG. 1 system and wall-mounting means taken about on line 11—11 of FIG. 10.

DETAILED DESCRIPTION OF AN ILLUSTRATED EMBODIMENT

Turning now to the drawings in greater detail and considering first FIG. 1, there is shown an office accessory system, generally indicated 20 and in accordance with the present invention, shown operatively attached to a vertical panel, indicated 22, in a first, or vertical, position of use. For purposes of attaching the accessory system 20 to the panel 22, wall-mounting means, generally indicated 24, is operatively connected to the panel 22, and the accessory system 20 is, in turn, operatively connected to the wall-mounting means 24. As will be explained in greater detail hereinafter, the office accessory system includes componentry, generally indicated 18 in FIGS. 3 and 7, permitting the office accessory system 20 to be selectively supported from the mounting means 24 in either the vertical position of use as illustrated in FIG. 1 or a second, or horizontal, position of use as illustrated in FIG. 10.

The vertical panel 22 from which the accessory system 20 is supported includes means defining a vertical surface 26. The vertical surface 26 is supported by means of a pair of vertically-oriented, hollow metal posts 28 (only one shown in FIG. 1) arranged at opposite ends of the vertical surface 26. Defined in a planar surface 27 of each vertical post 28, which planar surface generally faces in the same direction as does the vertical surface 26 are a series of vertically-spaced slots 32 extending therealong. The panel 22 is of a modular type commonly utilized for separting or defining work stations within an otherwise open work area, and as will be explained hereinafter, the vertical series of slots 32 provide the means by which the wall-mounting means 24 is attached to the panel 22.

With reference to FIGS. 1 and 2, the wall-mounting means 24 includes an elongated load bar 34 adapted to be operatively and supportively connected to the vertical panel 22. To this end, the load bar 34 includes two identically-constructed opposite ends 36 (only one shown in FIGS. 1 and 2) to which are fixedly attached a pair of plates 40 (only one shown in FIGS. 1 and 2), having vertically-spaced and downwardly-directed tooth formations 42 adapted to interfit with the slots 32 defined in each panel post 28.

As best shown in FIG. 2, each tooth formation 42 defines a gap 44 for interconnecting with the slot 32. To attach the plates 40 to the panel 22 in a manner operatively connecting the load bar 34 to the panel 22, the tooth formations 42 located at each end of the load bar 34 are inserted within corresponding slots 32 defined within a corresponding panel post 28 and permitted to lower to a condition at which the lower edge of each corresponding slot 32 is captured within the gap 44 of the corresponding tooth formation 42. Connected to the panel 22 as aforedescribed, load bar 34 is held in supportive engagement with the panel 22 by gravity influence.

The load bar 34 further includes means, generally indicated 46, for defining a vertical surface 48 which terminates along a horizontal edge 50. The surface-defining means 46 is provided by an elongated member 52 which has been extruded and appropriately formed to provide the vertical surface 48. The plates 40 are, in turn, affixed to the ends of the elongated member 52. Furthermore and as best illustrated in FIG. 2, the elongated member 52 is shaped adjacent the horizontal edge 50 so as to define a gap 53 positioned immediately rearwardly of the edge 50. As will be apparent hereinafter, the gap 53 accommodates the hooking of componentry 18 (FIG. 3 and 7) of the accessory system 20 about the edge 50.

With reference to FIGS. 1 and 3, the office accessory system 20 includes an office accessory 54 suitable for use in either vertical or horizontal orientations of use and further includes associated componentry, indicated 18 and introduced earlier, for mounting the accessory 54 in either an operative vertical or horizontal orientation from the load bar 34. The illustrated office accessory 54 includes means defining two opposite sides or ends 58, 60, a front 62, a back 64 and a bottom 66. Collectively, the sides 58,60, front 62, back 64 and bottom 66 define an open-ended compartment 68 adapted to receive items such as letters or files inserted edgewise therein. When positioned in the vertical orientation illustrated in FIG. 1, the accessory 54 provides the user with an upwardly-opening file holder. Conversely, when positioned in the horizontal position as illustrated in FIG. 10, the accessory 54 provides the user with a letter tray which opens generally forwardly of, or to one side of, the panel 22.

With reference again to FIGS. 1 and 3, the sides 58,60 are somewhat planar and generally parallel to one another, and the front 62 and back 64 are generally planar and parallel to one another and generally perpendicular to the ends 58 and 60. Furthermore, the bottom 66 is generally planar and perpendicular to the front 52, back 64 and sides 58 and 60. With reference to FIGS. 3, 5*a*, and 5*b* the accessory sides 58 and 60 include side panels 75 and 77, respectively. Furthermore and as best shown in FIGS. 3, 6*a* and 6*b*, the sides 58 and 60 include end caps 70 and 72, respectively, for covering the side panels 75 and 77.

Each cap 70 or 72 and its corresponding end 58 or 60 includes means permitting the cap 70 or 72 to be placed upon and thereby be securely retained in operative engagement with the corresponding side panel 75 or 77. To this end and with reference to FIGS. 5*a* and 5*b*, each side panel 75 or 77 includes a protruding flange 74 extending for a substantial distance around the boundary thereof, and with reference to 6*a* and 6*b*, the cap 70 or 72 includes a cooperating protruding flange 76 extending around the boundary thereof. The spaced bounded by the flange 76 is adapted to snuggly receive and thereby securely retain the side panel flange 74 when the cap 70 or 72 is operatively pressed upon the corresponding end panel 75 or 77. For a reason which will be hereinafter apparent, each side panel flange 74 defines cutouts 78 and 80 as best shown in FIGS. 5*a* and 5*b*.

With reference still to FIGS. 3, 4, 5*a* and 5*b*, each side panel 75 or 77 includes detent means, generally indicated 82, for cooperating with the componentry 18 of the accessory system 20 and thereby permitting the accessory 54 to be selectively suspended from the load bar 34 in the aforedescribed first or second position of use. The detent means 82 of the accessory system 20 include a pair of hollow circular projections or lugs 84,86 defined in each end panel 75 or 77 and oriented so as to project generally perpendicular to and generally away from the remainder of the panel 75 or 77. Each lug 84 is spaced from the back 64 of the accessory 54 a distance which is about equal to the spacing between the lug 86 and the bottom 66 of the accessory 54 for a reason hereinafter apparent. Furthermore, the detent means 82 including stop means 85 includes a first rib 88 and a second rib 90 which each project generally outwardly of the reminder of the panel 75 or 77, are located on opposite sides of the lug 84 and are disposed generally parallel to one another. The stop means 85 further includes a third outwardly-projecting rib 92 positioned adjacent the lug 86 and oriented to the side thereof opposite the portion of the panel flange 74 indicated 93. The distance as measured between the first and second ribs 88 and 90 is substantially equal to the spacing as measured between the rib 92 and the flange portion 93. In the accessory embodiment 54 illustrated, the detent means 82 and flange 74 are integrally moled into the side panels 75 and 77.

With reference to FIGS. 3 and 7 and in accordance with the present invention, the componentry 18 introduced earlier, of the accessory system 20 utilized for attaching the accessory 54 to the load bar 34 in either a vertical or horizontal orientation includes a pair of mounting brackets 94,96. Each mounting bracket 94 or 96 includes a first leg portion 98 which is generally platen-like in shape. The leg portion 98 includes two opposite faces 110, 112, two opposite side edges 106,108 extending between the faces 110,112, two opposite ends 102,104 extending between the side edges 106 and 108, and a circular opening 100 in the faces 110,112.

The bracket leg portion 98 is so sized so as to be positionable against either end panel 75 or 77 such as in the manner illustrated in FIGS. 8 or 10 so that the lug 84 or 86 is received by the leg portion opening 100 and the leg portion 98 is prevented from rotating rotating to the panel 75 or 77 about the corresponding lug 84 or 86 by the stop means 85 so that the bracket leg portion 98 is maintained in a relatively stationary relationship with the panel 75 or 77. To this end, the diameter of the bracket opening 100 is slightly larger than the diameter of each lug 84 or 86, and the distance as measured between the bracket side edges 106,108 is slightly smaller than the distance as measured between the ribs 88 and 90 and the rib 92 and flange portion 94. When each bracket 94 or 96 is operatively connected to the side panel 75 or 77 and as illustrated in FIGS. 8 or 10, the leg portion end 104 extends beyond the plane of the accessory back 64 or bottom 66, respectively. The flange cutouts 78 and 80 accommodate the aforedescribed extension of the leg portion end 104.

It will be understood from the foregoing that the leg portion 98 of each bracket 94 or 96 is structurally similar to the leg portion of the other bracket 96 or 94 and are so sized so that the brackets 94 or 96 can be interchanged with one another for purposes of attaching either bracket 94 or 96 to either the lug 84 or 86 of either end panel 75 or 77. As will be apparent hereinafter, the cooperation between the brackets 94,96 and accessory 54 permitting the brackets 94,96 to be operatively attached about either of the lugs 84 or 86 or to either side 58 or 60 of the accessory 54 is responsible for the permitted mounting of the accessory 54 from the load bar 34 in either the FIG. 1 vertical orientation or the FIG. 10 horizontal orientation.

With reference again to FIGS. 3, 7, 8 or 10, each bracket 94 or 96 further includes a second leg portion 114 operatively joined to the first leg portion 98. The second leg portion 114 includes a platen-like portion 116 joined along one edge to the end 104 of the first leg portion 98 so that the platen-like portion 116 forms a right angle with the first leg portion 98. As best shown in FIG. 7, the platen-like portion 116 of each second leg portion 114 is so joined to the corresponding first leg portion 98 so that the first leg portion 114 of bracket 94 extends to the right, as shown in FIG. 7, of its first leg portion 98 and so that the second leg portion 114 of bracket 96 extends to the left, as shown in FIG. 7, of its first leg portion 98. Hence, each bracket 94 or 96 is so constructed so as to be, in essence, a mirror image of the other bracket 96 or 94.

Each of the second leg portions 114 further includes a protruding portion 118 which is generally L-shaped in cross section and operatively joined to the platen-like portion 116 so as to form a hook 120. The hook 120 defines a generally rectilinear trough 122 adapted to accept the horizontal edge 50 of the FIG. 2 load bar 34 when operatively positioned thereover. As best shown in FIG. 7, the defined trough 122 of each hook 120 extends in a direction which is oriented generally perpendicular to the first leg portion 98. As will be apparent hereinafter, when the brackets 94 and 96 are operatively connected to the ends of the accessory 54, the bracket hooks 120 are in a condition to be operatively connected to the load bar 34 for supporting the accessory 54 in a desired manner.

In order to suspend the accessory 54 in a vertical position of use and with reference to FIGS. 1, 3, 8 and 9, the end caps 70 and 72 are removed from the corresponding side panels 75 and 77 to expose the lugs 84 and ribs 88,90 of the panels 75 and 77. The bracket 94 is then positioned against the side panel 75 so that the bracket opening 100 accepts the lug 84 and so that the bracket leg edges 106,108 are positioned between the ribss 88,90. With the bracket 94 positioned as aforesaid, the second leg portion 114 thereof is positioned behind the accessory back 62, and the hook 120 opens downwardly as shown in FIG. 8 when the accessory 54 is positioned vertically for use. At that point, the end cap 70 is replaced upon the side panel 75 so that the flange 76 (FIG. **6*a*) of the end cap is snuggly fitted and thereby securely retained upon the side panel 75**.

Similarly, the bracket 96 is positioned against the other side panel 77 so that the bracket opening 100 accepts the lug 84 and so that the bracket leg edges 106,108 are positioned between the ribs 88,90. With the bracket 96 positioned as aforesaid, the second leg portion 114 thereof is positioned behind the accessory back 62, and the hook 120 opens downwardly when the accesory 54 is positioned vertically for use. At that point, the end cap 72 is replaced upon the side panel 77 so that the flange 76 (FIG. **6*b*) of the end cap 77 is snuggly fitted and thereby securely retained upon the side panel 77**.

With reference again to FIGS. **4, 6*a* and 6*b* and to enhance the securement between the end caps 70,72 and the side panels 75 and 77, the end caps 70,72 each include a panel 124 and a pair of lugs 126,128 projecting from the panel 124. Each lug 126 or 128 is sized so as to be snuggly received by a corresponding one of the side panel lugs 84 or 86 when the corresponding end cap 70 or 72 is attached to the side panel 75 or 77. It follows from the foregoing that when the end caps 70 and 72 are operatively secured to the side panels 75 and 77, the brackets 94 and 96 are prevented from coming off of the side panel lugs 84 and 86**.

To attach the system 20 to the load bar 34 with the accessory 54 oriented vertically for use, the hooks 120,120 of the brackets 94,96 are manipulated over the horizontal edge 50 of the load bar 34 and the system 20 is lowered to a suspended condition at which gravity maintains the hooks 120,120 in a hooked relationship with the load bar 34. Inasmuch as the bottom of the accessory 54 tends to pivot rearwardly about the horizontal edge 50 due to the suspended condition of the accessory 54, the second leg portion 114 of each bracket 94 or 96 flatly engages the vertical surface 48 which, in turn, maintains the accessory 54 in somewhat of a cantilevered condition so that the front 62 and back 64 of the accessory 54 are oriented vertically and the open end of the accessory 54 opens generally upwardly.

In order to suspend the accessory 54 in a horizontal position of use and with reference to FIGS. 10 and 11, end caps 70,72 are removed from the corresponding side panels 75 and 77 to expose the lugs 86, ribs 92 and flange portion 93 of the panels 75 and 77. Bracket 94 is then positioned against the side panel 77 so that the bracket opening 100 accepts the lug 86 and so that the bracket leg edges 106,108 are positioned between the ribs 92 and flange portion 93. With the bracket 94 positioned as aforesaid, the second leg portion 114 thereof is positioned behind the accessory bottom 66, and the bracket hook 120 opens downwardly as shown in FIG.

10, when the accessory 54 is positioned horizontally for use. At that point, the end cap 72 is replaced upon the side panel 77 to securely attach the bracket 94 to the side panel 77.

Similarly, bracket 96 is positioned against the side panel 75 so that the bracket opening 100 accepts the lug 86 and so that the bracket leg edges 106,108 are positioned between the rib 92 and flange portion 93. With the bracket 94 positioned as aforesaid, the second leg portion 114 thereof is positioned behind the accessory bottom 66, and the bracket hook 120 opens downwardly when the accessory 54 is positioned horizontally for use. At that point, the end cap 72 is replaced upon the side panel 75 to securely attach the bracket 96 to the side panel 75.

To attach the system 20 to the load bar 34 with the accessory 54 oriented horizontally for use, the hooks 120,120 of the brackets 94,96 are manipulated over the horizontal edge 50 of the load bar 34 and the system 20 is lowered to a suspended condition at which gravity maintains the hooks 120,120 in a hooked relationship with the load bar 34. The weight of the accessory 54 presses the second leg portion 114 of each bracket 94 or 96 flatly against the vertical surface 48 of the load bar 34 which is, in turn, maintains the accessory 54 in a cantilevered condition so that the front 62 and back 64 of the accessory are oriented horizontally and the open end of the accessory 54 opens forwardly of the panel 22.

It will be understood that in order to switch the accessory system 20 between conditions at which the accessory 54 is supportable in vertical and horizontal positions of use involves a switching of brackets 94 is and 96 between the side panels 75 and 77. More specifically, bracket 94 is associated with said panel 75 when the accessory 54 is suspended vertically for use and is associated with side panel 77 when the accessory 54 is suspended horizontally for use. Similarly, bracket 96 is associated with side panel 77 when the accessory 54 is suspended vertically for use and is associated with side panel 75 when the accessory is suspended horizontally for use. Such switching of brackets 94,96 between panels 75,77 ensures that the second leg portion of each bracket 94,96 is operatively positioned behind the back 62 or bottom 66 of the accessory 54 so that the brackets 94,96 are substantially hidden from view when the accessory system 20 is operatively suspended from the load bar 34 whether the accessory 54 is oriented vertically or horizontally for use.

It follows from the foregoing that the cooperation between the detent means 82 of the accessory sides 58,60 and the componentry 18 enable the accessory 54 to be selectively supported from the load bar 34 in either a vertical position of use as illustrated in FIGS. 1 and 8 or a horizontal position of use as illustrated in FIG. 10. Such cooperation provides the use with flexibility as to how he might suspend the accessory 54 from a panel 22 and is advantageous in this request.

It will be understood that numerous modifications and substitutions can be had to the aforedescribed embodiment without departing from the spirit of the invention. For example, although the accessory 54 has been shown and described as an upwardly-opening file holder when oriented vertically for use and a forwardly-opening letter tray when oriented horizontally for use, it will be understood that an accessory within which this invention can be embodied can take the form of an alternative accessory as long as the alternative accessory is suitable for use in either a horizontal or vertical orientation. Accordingly, the aforedescribed embodiment is intended for purposes of illustration and not as limitation.

We claim:

1. A pair of mounting brackets for mounting an office accessory in either a horizontal position or a vertical position on a wall mounting, the wall mounting including a generally vertical surface having an uppermost horizontal edge; the pair of mounting brackets comprising:

first and second mirror image L-shaped mounting brackets, each of the first and second brackets including a first generally planar leg portion having parallel upper and lower edges and a lug receiving opening between the edges for receiving a lug carried by an associated end of the office accessory when the bracket is operatively associated to a corresponding end of the office accessory, and a second leg portion having a second generally planar portion disposed at substantially right angles to the first generally planar portion, the second generally planar portion being generally vertical when the mounting brackets are in their normal operational position, the second leg further including an upper hook portion carried by an upper portion of the second generally planar portion.

2. The pair of mounting brackets as set forth in claim 1 wherein each lug receiving opening is a circular aperture.

3. The pair of mounting brackets as set forth in claim 1 wherein each upper hook portion is of an inverted J-shape having a horizontal upper edge substantially the same length as the second generally planar portion.

4. The pair of mounting brackets as set forth in claim 1 wherein the second leg portion of each of the first and second L-shaped brackets is disposed inwardly of the first generally planar leg portion when the L-shaped mounting brackets are associated with a corresponding end of the office accessory.

5. An office accessory adapted to be mounted in either a vertical position or a horizontal position upon a wall mounting by a pair of spaced apart mounting brackets, the wall mounting having a generally vertical surface and an uppermost horizontal edge, and each bracket being provided with a hook adapted to engage the uppermost horizontal edge, a portion adapted to lie against the vertical surface of the wall mounting, and a first generally planar leg portion which, when the mounting bracket is in its normal operational position, is in vertical orientation and at right angles to the vertical surface of the wall mounting; the office accessory comprising:

a box-like structure having, when vertically oriented, a front side, a back side, a bottom side, and right and left opposite ends interconnected to the sides, each of the ends being provided with two detent means each capable of temporarily keeping the first leg portion of an associated mounting bracket in a certain position, the first detent means being open to the back and the second detent means being open to the bottom, each of the detent means including stop means spaced apart a distance slightly greater than the height of the first generally planar leg portion and means engagable with the first leg portion of an associated mounting bracket to prevent its relative movement with respect to the associated end; and right and left end caps, each right and left end cap being removably mounted to an associated right or left end of the box-like structure, respectively, and capable, when mounted in position of trapping the first leg portion of an associated bracket within the associated detent means but permitting the removal of the associated leg portion when the end cap is removed.

6. The office accessory as set forth in claim 5 wherein each generally planar leg portion is provided with a circular aperture, and the means engagable with the leg portion to prevent its relative movement is a hollow cylindrical projection.

7. The office accessory as set forth in claim 6 wherein each end cap is provided with lugs adapted to be disposed within the associated hollow cylindrical projection.

8. The office accessory as set forth in claim 5 wherein each generally planar leg portion is provided with upper and lower parallel sides, and wherein the stop means includes parallel walls spaced apart from each other a distance slightly greater than the width of the generally planar leg portion.

9. An office accessory system for mounting an office accessory in either a horizontal position or a vertical position on a wall mounting which includes a generally vertical surface having an uppermost horizontal edge, the office accessory system comprising:

first and second mirror image L-shaped mounting brackets, each mounting bracket including a first generally planar leg portion which, when the mounting bracket is in its normal position, is in vertical orientation and at right angles to the vertical surface of the wall mounting, the first leg portion having parallel upper and lower edges and a lug receiving opening between the edges, and a second leg portion having a generally planar portion disposed at substantially right angles to the first generally planar portion and adapted to lie against the vertical surface of the wall mounting, the second leg portion further including an upper hook portion adapted to be disposed over the uppermost horizontal edge of the wall mounting; and an office accessory adapted to be temporarily secured to the pair of mirror image mounting brackets in either a first position wherein the office accessory is disposed in a vertical position, or in a second position wherein the office accessory is disposed in a horizontal position, the office accessory including a box-like structure having, when vertically mounted, a front side, a back side, a bottom side, and right and left opposite ends interconnected to the sides, each of the ends being provided with two detent means each capable of temporarily keeping the first leg portion of an associated mirror image mounting bracket in a certain position, the first detent means being open to the back, and the second detent means being open to the bottom, each of the detent means including parallel stop means spaced apart a distance slightly greater than the height of the first leg portion, and a lug engagable with the lug receiving opening to prevent movement of an associated mounting bracket relative to the box-like structure, and right and left end caps removably mounted on an associated right or left end of the box-like structure, respectively, and capable, when mounted in position of trapping the first leg portion of the associated bracket within the associated detent means but permitting the removal of the associated leg portion when the end cap is removed.

10. The office accessory system as set forth in claim 9 wherein the lug receiving opening for each of the first and second L-shaped mounting brackets is a circular aperture, and the lug is a hollow cylindrical projection.

11. The office accessory system as set forth in claim 10 wherein each end cap is provided with projections adapted to be disposed within the associated hollow cylindrical projection.

12. The office accessory system as set forth in claim 9 wherein each upper hook portion is of an inverted J-shape having a horizontal upper edge substantially the same length as the second generally planar portion.

13. The office accessory system as set forth in claim 9 wherein the second leg portion of each of the first and second L-shaped mounting brackets is disposed inwardly of the first generally planar leg portion when the L-shaped mounting brackets are associated with a corresponding end of the office accessory.

* * * * *